US006796516B2

(12) United States Patent
Maier et al.

(10) Patent No.: US 6,796,516 B2
(45) Date of Patent: Sep. 28, 2004

(54) FUEL INJECTION VALVE

(75) Inventors: Martin Maier, Moeglingen (DE); Joerg Heyse, Besigheim (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/181,072

(22) PCT Filed: Nov. 12, 2001

(86) PCT No.: PCT/DE01/04209

§ 371 (c)(1),
(2), (4) Date: Oct. 28, 2002

(87) PCT Pub. No.: WO02/38949

PCT Pub. Date: May 16, 2002

(65) Prior Publication Data

US 2003/0121998 A1 Jul. 3, 2003

(30) Foreign Application Priority Data

Nov. 11, 2000 (DE) ..... 100 56 006

(51) Int. Cl.[7] ..... F02M 61/00

(52) U.S. Cl. ..... 239/533.12; 239/533.11; 239/585.2; 239/596; 239/467; 239/494; 239/496

(58) Field of Search ..... 239/596, 533.12, 239/533.11, 466, 467, 468, 482, 491, 494, 496, 497, 585.2, 585.4, 585.5

(56) References Cited

U.S. PATENT DOCUMENTS 2,746,801 A * 5/1956 Curran ..... 239/494
4,828,184 A * 5/1989 Gardner et al. ..... 239/590.3
5,437,413 A * 8/1995 Shen et al. ..... 239/424.5
5,685,491 A * 11/1997 Marks et al. ..... 239/533.12
6,161,782 A * 12/2000 Heinbuck et al. ..... 239/585.1

FOREIGN PATENT DOCUMENTS

| | | |
|---|---|---|
| DE | 196 07 288 | 10/1996 |
| DE | 196 37 103 | 3/1998 |
| DE | 198 15 795 | 10/1999 |
| DE | 199 47 780 | 4/2001 |
| JP | 60 222557 | 11/1985 |

* cited by examiner

*Primary Examiner*—Dinh Q. Nguyen
(74) *Attorney, Agent, or Firm*—Kenyon & Kenyon

(57) ABSTRACT

A fuel injector is described having a movable valve part, which for opening and closing of the valve cooperates with a stationary valve seat which is formed on a valve seat element. A swirl disk is arranged downstream from the valve seat and has a multilayer configuration. The fuel flowing through is imparted to a swirl component between at least one inlet area and at least one outlet area. In a first swirl-generating plane a swirl component is imparted to a first portion of the flow, while a second portion of the flow without swirl and independent of the first swirling portion of the flow is routed inside the swirl disk, and in a second swirl-generating plane a swirl component is imparted only to the second portion of the flow. The fuel injector may be suitable for direct injection of fuel into a combustion chamber of an internal combustion engine having compression of a fuel/air mixture with spark ignition.

23 Claims, 4 Drawing Sheets

FUEL INJECTION VALVE

FIELD OF THE INVENTION

The present invention relates to a fuel injector.

BACKGROUND INFORMATION

A fuel injector which may be electromagnetically actuated is described in German Published Patent Application No. 196 37 103, in which a swirl-generating arrangement is provided downstream from a valve seat. The swirl-generating arrangement is shaped in such a manner that at least two streams may be created from the fuel which run radially offset with respect to one another while mutually enveloping or enclosing one another and which have different directional orientations. The arrangement for creating the injection jet composed of an inner and an outer stream having different directional orientations may be quite complicated and relatively expensive to manufacture on account of the flow blades which serve as guide elements and the multilayer swirl mountings on a perforated disk. The swirl-generating arrangement may be configured in such a manner that either a swirling solid conical jet or a swirling hollow conical jet exits from the fuel injector.

The technique referred to as multilayer metal plating for the manufacture of perforated disks which may be particularly suited for use in fuel injectors has already been described in German Published Patent Application 196 07 288. This principle for manufacturing disks by multiple metal electrodeposition of various structures one on top of the other to produce a one-piece disk may be expressly included in the disclosure content of the present invention. Microelectrodeposition in multiple planes or layers may also be used to manufacture the swirl disks according to the present invention.

SUMMARY OF THE INVENTION

A fuel injector according to an example embodiment of the present invention may achieve a high-quality atomization of a fuel to be injected. Using a fuel injector according to an example embodiment of the present invention, a double swirl may be generated in a swirl disk which may be integrated into the fuel injector, the double swirl generation occurring in the same direction in the fluid so that a finely atomized, hollow conical spray jet composed of two hollow conical lamellae concentrically arranged one inside the other may be injected. As a result, among other things, the exhaust emissions from the internal combustion engine may be reduced and likewise the fuel consumption may be decreased in a fuel injector of an internal combustion engine.

The swirl-generating element may be configured in the shape of a multilayer swirl disk so that a double swirl may be created. The swirl disk may be manufactured using the technique referred to as multilayer metal plating. On account of their metallic construction, such swirl disks may be break-resistant and easy to install. Use of multilayer metal plating may allow high freedom in the configuration, since the contours of the opening areas (inlet area, swirl channels, swirl chambers, outlet openings) in the swirl disk may be freely selected. Compared to silicon discs in particular, whose crystal axes may strictly dictate the contours which may be achieved (truncated pyramids), this flexible shaping may be desirable.

In comparison to the manufacture of silicon disks in particular, metal deposition may provide a large variety of usable materials. Many varied types of metals having different magnetic properties and hardnesses may be used in microelectrodeposition for the manufacturing of swirl disks.

The swirl disks may be constructed using five layers by performing four or five, for example, electrodeposition steps for multilayer metal plating. The upstream layer represents a top layer which may completely cover the swirl chamber of a first middle swirl-generating layer. The swirl-generating layer is formed from a plurality of material areas which on account of their contouring and geometric position with respect to one another may determine the contours of the swirl chambers and swirl channels. This may also apply to a second middle swirl-generating layer which may be separated from the first swirl-generating layer by a middle forwarding layer, but which may be in hydraulic connection with the first swirl-generating layer via flow openings in the forwarding layer. A swirling portion of the flow as well as a portion of the flow without swirl and independent of the swirling portion of the flow enter the forwarding layer, the portion of the flow without swirl being transmitted into the second swirl-generating layer for imparting swirl. The individual layers may be successively applied to one another by electrodeposition, without separation areas or joint areas, in such a manner that they represent a material which may be homogeneous throughout. In this regard, the term "layers" is intended as a conceptual aid.

The swirl disc may be provided with at least two, or alternatively four, swirl channels for each swirl-generating layer for imparting a swirl component to the fuel. The material areas may have very different shapes, corresponding to the desired contouring.

DETAILED DESCRIPTION

Figure 1:
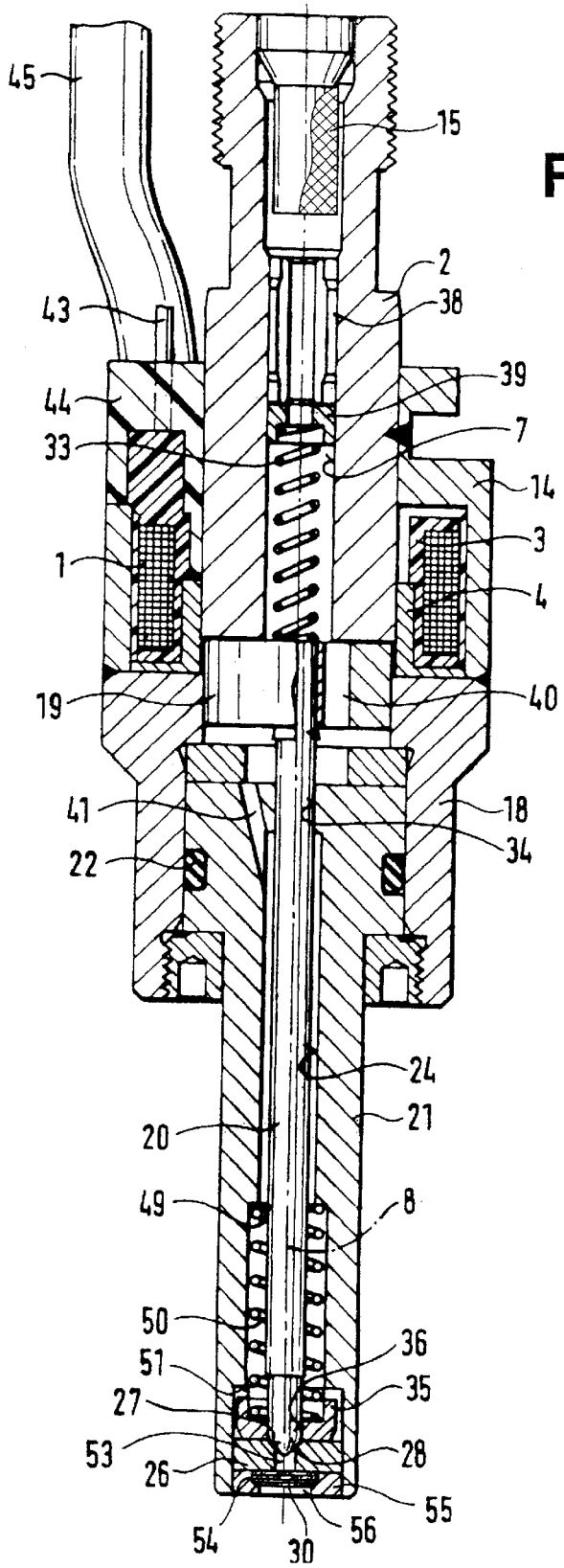
FIG. 1 shows a partial section of a fuel injector.

The valve, which as an example is illustrated in FIG. 1 as electromagnetically activatable, and in the form of an injector for fuel injection systems in internal combustion engines having compression of a fuel/air mixture with spark ignition, has a tubular, substantially hollow cylindrical core 2 which is at least partially enclosed by a solenoid 1 and which acts as an internal pole of a magnetic circuit. The fuel injector may be particularly suitable as a high-pressure injector for direct injection of fuel into a combustion chamber of an internal combustion engine.

A bobbin 3 made of plastic, which has a stepped configuration, for example, accommodates a winding of solenoid 1 and, in conjunction with core 2 and an annular, nonmagnetic intermediate part 4 which is partially enclosed by solenoid 1, may allow a particularly compact and short configuration of the injector in the region of solenoid 1.

A continuous longitudinal opening 7 is provided in core 2 which extends along a longitudinal valve axis 8. Core 2 of the magnetic circuit also serves as a fuel inlet connector, longitudinal opening 7 representing a fuel supply duct. Above solenoid 1, core 2 is firmly attached to outer metallic (ferritic, for example) housing part 14, which as a stationary pole or external guide element closes the magnetic circuit and completely encloses solenoid 1, at least in the circumferential direction. A fuel filter 15 is provided on the inflow side in longitudinal opening 7 of core 2 for filtering out fuel components which because of their size may cause blockage or damage in the injector.

A lower tubular housing part 18 is tightly and permanently joined to upper housing part 14 and encloses or accommodates an axially movable valve part having an armature 19, a rod-shaped valve needle 20, and an elongated valve seat support 21. Both housing parts 14 and 18 may be permanently joined together by a circumferential weld, for example. The seal between housing part 18 and valve seat support 21 may be created by a sealing ring 22, for example.

With its lower end, which at the same time represents the downstream end of the entire fuel injector, valve seat support 21 encloses a disk-shaped valve seat element 26 which is fitted into a through opening 24 and which has valve seat face 27 tapering in the downstream direction in the shape of a frustum, for example. Valve needle 20 is arranged in through opening 24 and has a valve closing section 28 on its downstream end. This valve closing section 28, which tapers in a conical shape, for example, cooperates in a conventional manner with valve seat face 27. Downstream from valve seat face 27, following valve seat element 26, there is a swirl-generating element in the form of a swirl disk 30 which is manufactured by multilayer metal plating, for example, and which has five metallic layers successively deposited on one another.

The injector is actuated in a conventional manner, for example by an electromagnetic arrangement. The electromagnetic circuit, which has solenoid 1, core 2, housing parts 14, and 18, and armature 19, is used to axially move valve needle 20 and thus to open the injector against the elastic force of a restoring spring 33 arranged in longitudinal opening 7 of core 2, and to close the injector. In order to guide valve needle 20 during its axial movement together with armature 19 along longitudinal valve axis 8, a guide opening 34 provided in valve seat support 21 on the end facing toward armature 19, and a disk-shaped guide element 35, having a dimensionally accurate guide opening 36 is provided upstream from valve seat element 26.

Instead of the electromagnetic circuit, another energizable actuator such as a piezoelectric stack may be used in a comparable fuel injector, or the axially movable valve part may be actuated by hydraulic pressure or servopressure.

An adjusting sleeve 38 which is inserted, pressed, or screwed into longitudinal opening 7 of core 2 is used for adjusting the spring pre-tension of restoring spring 33, which on its upstream side rests on adjusting sleeve 38 via a centering element 39, and which on its other side is supported by armature 19. One or multiple borehole-like flow channels 40 are provided in armature 19 through which the fuel is able to travel from longitudinal opening 7 in core 2, via connecting channels 41 arranged downstream from flow channels 40 near guide opening 34 in valve seat support 21, to through opening 24.

The lift of valve needle 20 is predetermined by the installation position of valve seat element 26. When solenoid 1 is not energized, one end position of valve needle 20 is determined by the contact of valve closing section 28 with valve seat face 27, and when solenoid 1 is energized, the other end position of valve needle 20 is determined by the contact of armature 19 with the downstream end face of core 2.

Solenoid 1 is electrically contacted and thus energized via contact elements 43 which are provided with a plastic extrusion coating 44 on the outside of bobbin 3 and which in their continuation run as a connecting cable 45. Plastic extrusion coating 44 may also extend over additional components (housing parts 14 and 18, for example) of the fuel injector.

A first shoulder 49 in through opening 24 acts as a contact surface for a pressure spring 50 having a helical shape, for example. A second level 51 creates an enlarged space for the installation of three disk-shaped elements 35, 26, and 30. Pressure spring 50, which envelops valve needle 20, pre-tensions guide element 35 in valve seat support 21 by pressing against guide element 35 with its side which is arranged opposite shoulder 49. An outlet opening 53 is introduced in valve seat element 26, downstream from valve seat face 27, through which the fuel flowing along valve seat face 27 flows when the valve is open in order to subsequently enter swirl disk 30. Swirl disk 30 is arranged, for example, in a recess 54 in a disk-shaped retaining element 55 which is firmly attached to valve seat support 21 by welding, gluing, or clamping, for example. A central outlet opening 56 is formed in retaining element 55 through which the swirling fuel leaves the fuel injector.

Figure 2:
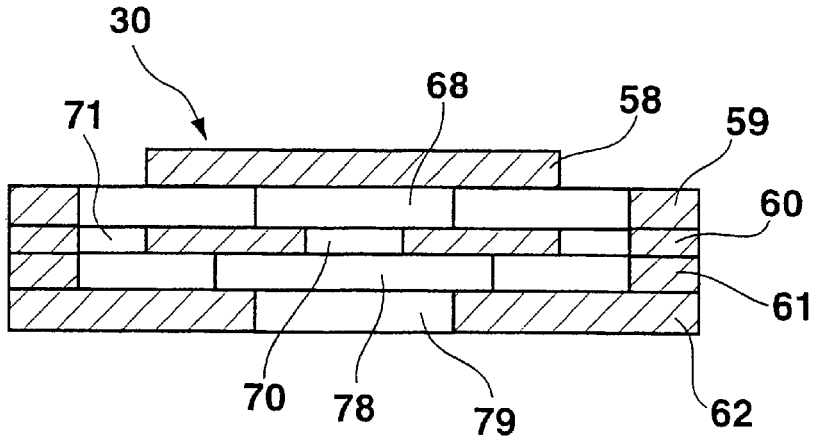
FIG. 2 shows a partial section through a swirl disk which may be integrated into the fuel injector.
Figure 3:
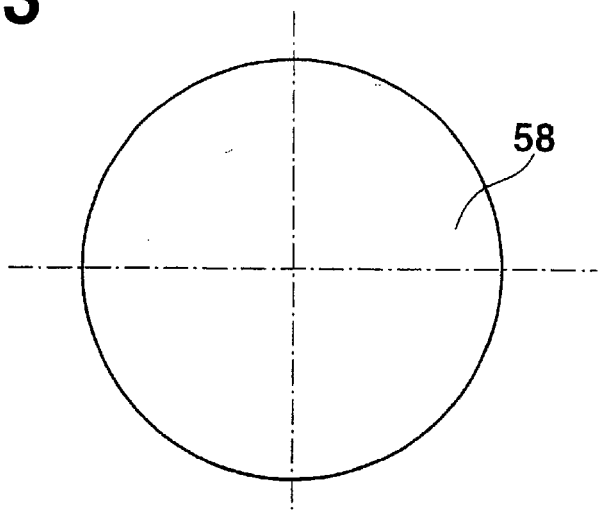
FIGS. 3 through 7 show conceptual top views of the individual plies or layers of the swirl disk according to FIG. 2.
Figure 4:
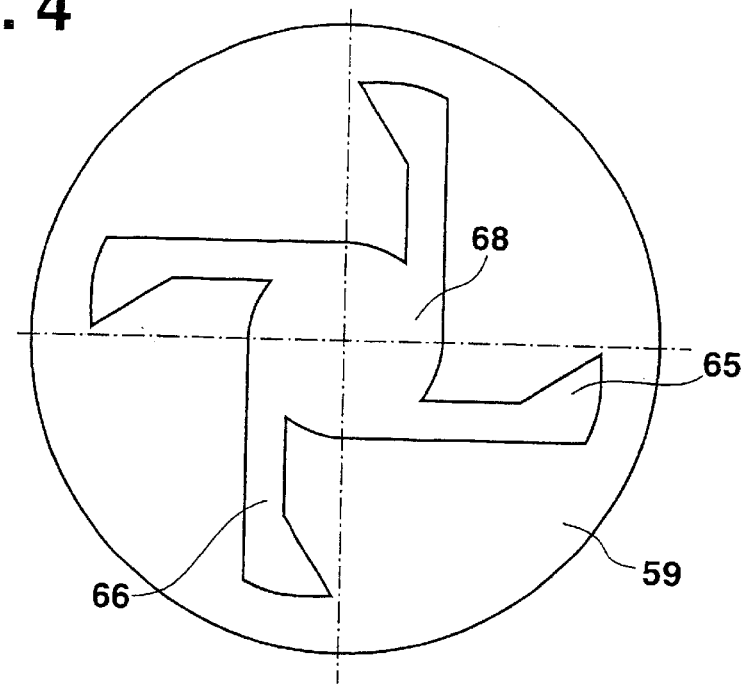
Figure 5:
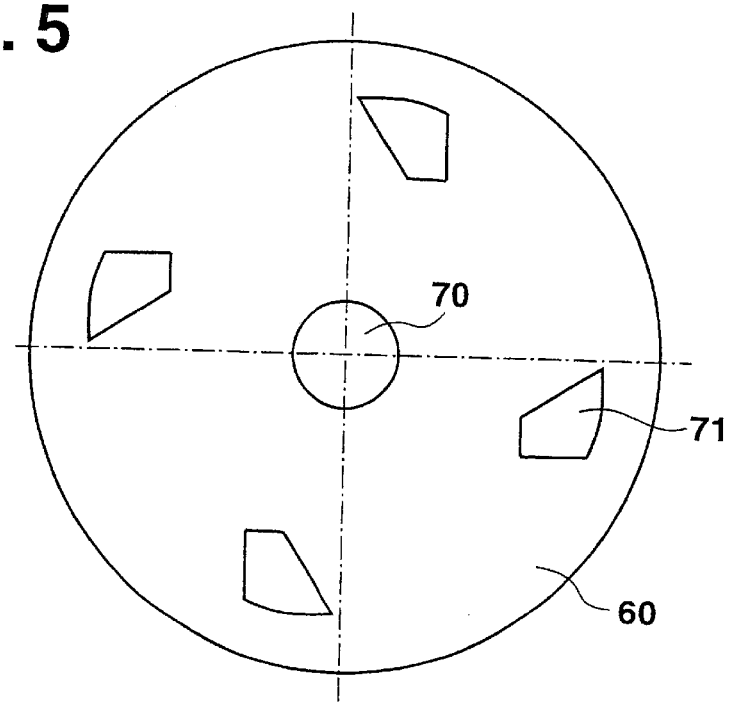
Figure 6:
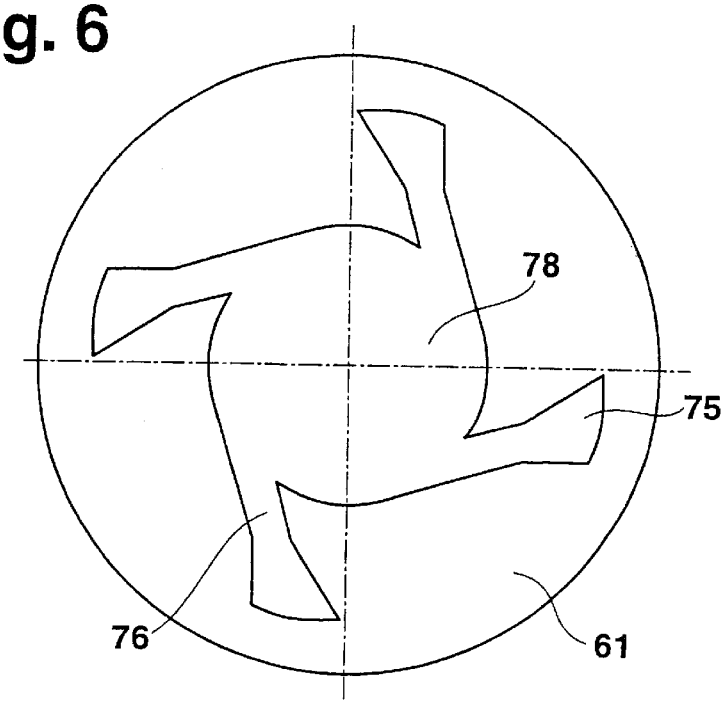
Figure 7:
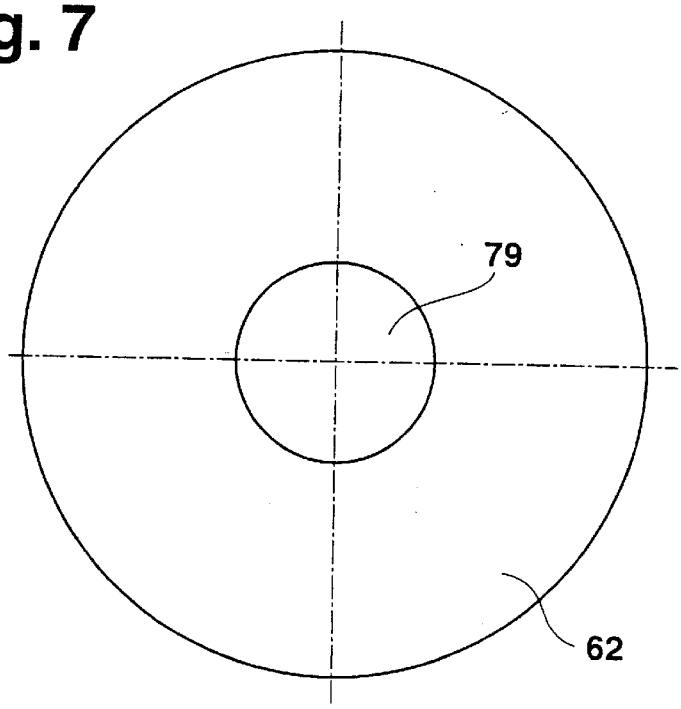

FIG. 2 shows a partial section through swirl disk 30, while FIGS. 3 through 7 show conceptual top views of the individual layers of the swirl disk according to FIG. 2.

Swirl disk 30 is formed from five flat planes or layers, joined together by electrodeposition, which in the installed state are arranged successively in the axial direction. In the following description, the five layers of swirl disk 30 are designated, according to their function, as top layer 58, first swirl-generating layer 59, forwarding layer 60, second swirl-generating layer 61, and base layer 62. For better fuel flow into swirl disk 30, for example, upper top layer 58 has a smaller outer diameter than all the other layers 59, 60, 61, 62.

In this manner it may be ensured that the fuel is able to flow from the outside, past top layer 58 and, thus unhindered, to enter outer inlet areas 65 of four, for example, swirl channels 66 in first swirl-generating layer 59. Upper top layer 58 represents a closed metallic layer which has no opening areas permitting flow-through. First swirl-generating layer 59 is provided with a complex opening contour which runs over the entire axial depth of this layer 59. The opening contour of layer 59 is formed from an internal swirl chamber 68 and a plurality (two, four, six, or eight, for example) of swirl channels 66 opening into swirl chamber 68. In the illustrated embodiment, swirl disk 30 has four swirl channels which open tangentially into swirl chamber 68.

Whereas swirl chamber 68 is completely covered by top layer 58, swirl channels 66 are only partially covered, since the outer ends facing away from swirl chamber 68 form inlet areas 65 which are open on top. In the region of a middle forwarding layer 60 arranged immediately downstream, the flow is divided into two parts, a first and a second portion of the flow, since in addition to a central through opening 70 there are additional outer through openings 71 provided in forwarding layer 60 which extend in the same number of swirl channels 66, downstream from and directly below inlet area 65. The second portion of the flow enters through these through openings 71 and may not take the path through swirl channels 66 in swirl-generating layer 59 arranged above. The first portion of the flow flows through swirl channels 66 into swirl chamber 68, and from there into flow opening 70, which has a rather small diameter, the angular momentum imparted to the fuel also being maintained in central flow opening 70.

Adjoining forwarding layer 60 is a second swirl-generating layer 61 which has a configuration similar to that of first swirl-generating layer 59. However, the orientation of inlet areas 75 and of swirl channels 76 may vary from first swirl-generating layer 59. A special feature is that swirl chamber 78 of second swirl-generating layer 61 has a larger opening width than does swirl chamber 68 of first swirl-generating layer 59. Second swirl-generating layer 61 is configured so that the entire second portion of the flow which flows through openings 71 enters swirl channels 76. The entire flow leaves swirl disk 30 through a central outlet opening 79 in lower base layer 62.

The second flow which flows through second swirl-generating layer 61 leaves as a wide hollow cone lamella through outlet opening 79. An inner hollow cone lamella which flows into this outer hollow cone lamella is formed from the swirl flow which is created in first swirl-generating layer 59 and brought to a small diameter through narrow flow opening 70. Using swirl disk 30, two hollow conical lamellae may be created, concentrically arranged one inside the other, which because of the enlarged spray surface may achieve particularly fine atomization. A condition for optimal atomization may include that the diameter of flow opening 70 of forwarding layer 60 may be required to be smaller than the diameter of swirl chamber 78, and may be required to be even smaller than the diameter of outlet opening 79 of base layer 62. Ideally, the cross sections of swirl channels 66 of first swirl-generating layer 59 are larger than those of swirl channels 76 of second swirl-generating layer 61, as the result of which the cone angle of the inner hollow cone lamella may be kept small in relation to the outer hollow cone lamella.

Swirl disk 30 may be constructed in a plurality of metallic layers by electrodeposition (multilayer metal plating), for example. Based on manufacturing using deep lithographic electroplating methods, there are particular features in the contouring, several of which are briefly summarized below:

Layers having constant thickness over the disk surface,

As a result of the deep lithographic structuring, substantially vertical indentations in the layers which form the respective cavities having flow-through (as dictated by the manufacturing process, deviations of approximately 3° in relation to optimally vertical walls may be present), Desired undercuts and overlaps of the indentations due to the multilayer construction of individually structured metal layers, Indentations having any cross-sectional shapes which are essentially parallel to the axis, and One-piece configuration of the swirl disk, since the individual metal depositions directly follow one another in succession.

In the following sections, an example method of manufacturing swirl disks 30 is explained only briefly. All the process steps for multilayer metal plating in the manufacture of a perforated disk may have already been described in detail in German Published Patent Application No. 196 07 288. One characteristic of the example method of successive application of photolithographic steps (UV deep lithography) and subsequent microelectrodeposition is that high precision of structures may be ensured, even on a large-surface scale, so that it may be ideal for use in mass production involving a very large number of work pieces (high batchability). Numerous swirl disks 30 may be produced simultaneously on one panel or wafer.

The starting point for the example method is a flat, stable substrate which may be made of metal (titanium, steel), silicon, glass, or ceramic, for example. Optionally, at least one auxiliary layer is applied to the substrate first. For this purpose, an electrodeposition base layer (TiCuTi, CrCuCr, Ni, for example) may be used which may be required for electrical conductance for the subsequent microelectrodeposition. The auxiliary layer may be applied by sputtering or currentless metal deposition, for example. After this pretreatment of the substrate, a photoresist is applied to the entire surface of the auxiliary layer by lamination or spin-on deposition, for example.

The thickness of the photoresist may correspond to the thickness of the metal layer to be produced in the subsequent electrodeposition process, and thus to the thickness of lower base layer 62 of swirl disk 30. The resist layer may be made of one or multiple plies of a photostructurable film or a liquid resist (polyimide, photoresist). If a sacrificial layer is to be optionally plated onto the subsequently produced coating structure, the thickness of the photoresist may be increased by the thickness of the sacrificial layer. The metal structure to be produced may be inversely transferred into the photoresist using a photolithographic mask. Optionally, the photoresist may be exposed (UV deep lithography) to UV radiation (printed board or semiconductor exposure system) directly over the mask and subsequently developed.

The negative structure which may ultimately result in the photoresist for subsequent layer 62 of swirl disk 30 is filled by electroplating with metal (Ni, NiCo, NiFe, NiW, Cu, for example). As the result of electrodeposition, the metal conforms closely to the contour of the negative structure so that the shape of the predetermined contour may be faithfully reproduced in the negative structure. To produce the structure of swirl disk 30, the steps following the optional application of the auxiliary layer may be required to be repeated corresponding to the number of layers desired, so that for a five-layer swirl disk 30, four (one-time lateral overgrowth) or five electrodeposition steps are performed. Various other metals may be used for the layers of a swirl disk 30, provided that their use requires only one new electrodeposition step per layer.

After deposition of upper top layer 58, the remaining photoresist may be leached from the metal structures by wet chemical stripping. For smooth, passivated substrates, swirl disks 30 may be detached from the substrate and isolated. For substrates having considerable adhesion of swirl disks 30, the sacrificial layer may be etched away selectively with regard to the substrate and swirl disk 30, and swirl disks 30 may be lifted off the substrate and cut up.

What is claimed is:

1. A fuel injector for a fuel injector system of an internal combustion engine, comprising:

an actuator;

a valve seat element;

a stationary valve seat formed on the valve seat element;

a movable valve part arranged to cooperate with the stationary valve seat for opening and closing a valve;

a swirl disk arranged downstream from the stationary valve seat and including a multilayer configuration, the swirl disk including at least one inlet area and at least one outlet area for applying a swirl component to a fluid to be spray-discharged between the at least one inlet area and the at least one outlet area, the swirl disk further including a first swirl-generating plane in which the swirl component is imparted to a first portion of a flow and in which a second portion of the flow is routed without swirl and independently of the first portion, and a second swirl-generating plane in which the swirl component is imparted only to the second portion of the flow.

2. The fuel injector according to claim 1, wherein the fuel injector is used for a direct injection of fuel into a combustion chamber of the internal combustion engine.

3. The fuel injector according to claim 1, wherein the swirl disk is manufacturable by electrodeposition of a metal.

4. The fuel injector according to claim 1, wherein the first and second swirl-generating planes are formed from a plurality of swirl channels and respective swirl chambers.

5. The fuel injector according to claim 4, wherein the swirl chamber of the first swirl-generating plane has an opening width that is smaller than that of the swirl chamber of the second swirl-generating plane.

6. A fuel injector for a fuel injector system of an internal combustion engine, comprising:

an actuator;

a valve seat element;

a stationary valve seat formed on the valve seat element;

a movable valve part arranged to cooperate with the stationary valve seat for opening and closing a valve; and a swirl disk arranged downstream from the stationary valve seat and including a multilayer configuration, the swirl disk including at least one inlet area and at least one outlet area for applying a swirl component to a fluid to be spray-discharged between the at least one inlet area and the at least one outlet area, the swirl disk including a first swirl-generating plane in which the swirl component is imparted to a first portion of a flow and in which a second portion of the flow is routed without swirl and independently of the first portion, the swirl disk including a second swirl-generating plane in which the swirl component is imparted only to the second portion of the flow;

wherein the swirl disk includes five layers.

7. A fuel injector for a fuel injector system of an internal combustion engine, comprising:

an actuator;

a valve seat element;

a stationary valve seat formed on the valve seat element;

a movable valve part arranged to cooperate with the stationary valve seat for opening and closing a valve; and a swirl disk arranged downstream from the stationary valve seat and including a multilayer configuration, the swirl disk including at least one inlet area and at least one outlet area for applying a swirl component to a fluid to be spray-discharged between the at least one inlet area and the at least one outlet area, the swirl disk including a first swirl-generating plane in which the swirl component is imparted to a first portion of a flow and in which a second portion of the flow is routed without swirl and independently of the first portion, the swirl disk including a second swirl-generating plane in which the swirl component is imparted only to the second portion of the flow;

wherein the first and second swirl-generating planes are configured so that the flow leaves a central outlet opening as two hollow conical lamellae concentrically arranged one inside another.

8. The fuel injector according to claim 7, wherein portions of the flow which form the two hollow conical lamellae swirl in a same direction.

9. The fuel injector according to claim 7, wherein the fuel injector is used for a direct injection of fuel into a combustion chamber of the internal combustion engine.

10. The fuel injector according to claim 7, wherein the swirl disk is manufacturable by electrodeposition of a metal.

11. The fuel injector according to claim 7, wherein the first and second swirl-generating planes are formed from a plurality of swirl channels and respective swirl chambers.

12. The fuel injector according to claim 11, wherein the swirl chamber of the first swirl-generating plane has an opening width that is smaller than that of the swirl chamber of the second swirl-generating plane.

13. A fuel injector for a fuel injector system of an internal combustion engine, comprising:

an actuator;

a valve seat element;

a stationary valve seat formed on the valve seat element;

a movable valve part arranged to cooperate with the stationary valve seat for opening and closing a valve; and a swirl disk arranged downstream from the stationary valve seat and including a multilayer configuration, the swirl disk including at least one inlet area and at least one outlet area for applying a swirl component to a fluid to be spray-discharged between the at least one inlet area and the at least one outlet area, the swirl disk including a first swirl-generating plane in which the swirl component is imparted to a first portion of a flow and in which a second portion of the flow is routed without swirl and independently of the first portion, the swirl disk including a second swirl-generating plane in which the swirl component is imparted only to the second portion of the flow;

wherein the first and second swirl-generating planes are formed from a plurality of swirl channels and respective swirl chambers;

wherein the swirl channels of the first swirl-generating plane have a cross section that is larger than that of the swirl channels of the second swirl-generating plane.

14. The fuel injector according to claim 13, wherein the fuel injector is used for a direct injection of fuel into a combustion chamber of the internal combustion engine.

15. The fuel injector according to claim 13, wherein the swirl disk is manufacturable by electrodeposition of a metal.

16. The fuel injector according to claim 13, wherein the first and second swirl-generating planes are formed from a plurality of swirl channels and respective swirl chambers.

17. The fuel injector according to claim 16, wherein the swirl chamber of the first swirl-generating plane has an opening width that is smaller than that of the swirl chamber of the second swirl-generating plane.

18. A fuel injector for a fuel injector system of an internal combustion engine, comprising:

an actuator;

a valve seat element;

a stationary valve seat formed on the valve seat element;

a movable valve part arranged to cooperate with the stationary valve seat for opening and closing a valve;

a swirl disk arranged downstream from the stationary valve seat and including a multilayer configuration, the swirl disk including at least one inlet area and at least one outlet area for applying a swirl component to a fluid to be spray-discharged between the at least one inlet area and the at least one outlet area, the swirl disk including a first swirl-generating plane in which the swirl component is imparted to a first portion of a flow and in which a second portion of the flow is routed without swirl and independently of the first portion, the swirl disk including a second swirl-generating plane in which the swirl component is imparted only to the second portion of the flow; and a forwarding layer arranged between the first and the second swirl-generating planes and into which a flow opening for the first portion of the flow and at least one through opening for the second portion of the flow without the swirl are introduced.

19. The fuel injector according to claim 18, further comprising:

a base layer into which the at least one outlet area is introduced, wherein the at least one outlet area has a diameter that is larger than the flow opening.

20. The fuel injector according to claim 18, wherein the fuel injector is used for a direct injection of fuel into a combustion chamber of the internal combustion engine.

21. The fuel injector according to claim 18, wherein the swirl disk is manufacturable by electrodeposition of a metal.

22. The fuel injector according to claim 18, wherein the first and second swirl-generating planes are formed from a plurality of swirl channels and respective swirl chambers.

23. The fuel injector according to claim 22, wherein the swirl chamber of the first swirl-generating plane has an opening width that is smaller than that of the swirl chamber of the second swirl-generating plane.

* * * * *